US005647196A

United States Patent [19]

Wassenhoven

[11] Patent Number: 5,647,196

[45] Date of Patent: Jul. 15, 1997

[54] OPEN-END SPINNING FRAME

[75] Inventor: Heinz-Georg Wassenhoven, Mönchengladbach, Germany

[73] Assignee: W. Schlafhorst AG & Co., Moenchengladbach, Germany

[21] Appl. No.: 570,709

[22] Filed: Dec. 11, 1995

[30] Foreign Application Priority Data

Dec. 16, 1994 [DE] Germany ..... 44 44 851.1

[51] Int. Cl.[6] ..... D01H 11/00

[52] U.S. Cl. ..... 57/301; 57/1 R; 57/304; 57/406; 57/407

[58] Field of Search ..... 57/1 R, 301, 304, 57/406, 407, 412, 413

[56] References Cited

U.S. PATENT DOCUMENTS

| | | | |
|---|---|---|---|
| 3,924,397 | 12/1975 | Stahlecker et al. | 57/301 |
| 4,162,556 | 7/1979 | Van Ditshuizen et al. | 57/301 |
| 4,177,629 | 12/1979 | Kennedy | 57/301 |
| 4,183,201 | 1/1980 | Stahlecker | 57/301 |
| 4,516,396 | 5/1985 | Stahlecker et al. | 57/1 R |
| 5,419,111 | 5/1995 | Wassenhoven et al. | 57/407 |
| 5,481,862 | 1/1996 | Wasenhoven | 57/301 |
| 5,540,043 | 7/1996 | Raasch | 57/407 |

FOREIGN PATENT DOCUMENTS

| | | |
|---|---|---|
| 2112170 | 9/1972 | Germany . |
| 115925 | 10/1975 | Germany . |
| 2856058C2 | 3/1985 | Germany . |
| 4310810A1 | 10/1994 | Germany . |
| 4334483A1 | 4/1995 | Germany . |

OTHER PUBLICATIONS

*Autocoro Manual*, "Schmutzabtransport", Apr. 1992, p. 1.3.20.

*Primary Examiner*—William Stryjewski
*Attorney, Agent, or Firm*—Shefte, Pinckney & Sawyer

[57] ABSTRACT

A pneumatic debris aspirating device adapted to be retrofitted on open-end spinning frames originally designed for a mechanical debris disposal installation utilizes an asymmetrical debris pickup funnel which can be connected via a connector conduit to a source of suction which is part of the spinning mill. The debris aspirating device is embodied and disposed such that opening of a cover to each rotor spinning unit is not hampered.

9 Claims, 4 Drawing Sheets

OPEN-END SPINNING FRAME

FIELD OF THE INVENTION

The present invention relates generally to an open-end spinning frame having a plurality of rotor-type spinning stations in alignment with each other, and relates more particularly to a novel debris disposal arrangement associated with the spinning stations.

BACKGROUND OF THE INVENTION

Open-end spinning frames of this type are known and typically have at each spinning station a spinning rotor supported on a supporting disk seat for rotation in a rotor housing on which a vacuum is applied. Each spinning station includes a pivoted cover on which is disposed a sliver opening device having a rotating opening cylinder for delivering opened fibers into the rotor and a fiber conduit plate for closing the front of the rotor housing. Each spinning station has a debris discharge opening in the pivoted rotor housing cover which communicates with a debris disposal arrangement extending along the spinning frame.

One such representative spinning frame is described, for example, in the manual "AUTOCORO" of the W. Schlafhorst AG & Co. As shown on page 1.3.20, an endless moving debris conveying belt extends the length of the machine underneath the sliver opening devices of the spinning units of the rotor spinning frame for receiving debris discharged through the debris discharge openings of the pivoted rotor housing covers and for conveying such debris to transfer stations disposed at the end of the machine, into which the belts are emptied.

Alternatively, it is also known to provide pneumatic debris aspirating devices in the area of the sliver opening devices in place of such mechanical debris disposal arrangements. For example, German Patent Publication DE 21 12 170 A1 describes a rotor spinning device in which a sliver fed between a draw-in roller and a feed trough is opened into individual fibers by means of an opening cylinder. In the course of this process, debris particles and fibers are also separated to the greatest extent possible. The opening cylinder conveys both components over a fiber guide surface into the area of a debris outlet opening. In the course of this conveyance, the fibers as well as the debris particles are accelerated by the opening cylinder or by the air flow circulating along with opening cylinder to approximately the circumferential speed of the opening cylinder. In the process, the fibers and debris particles have a tendency to leave the circular path tangentially as soon as the compulsory mechanical guidance is interrupted, such as takes place in the area of the debris outlet opening of the opening cylinder housing.

A debris collection chamber is disposed immediately below the debris outlet opening and is connected to a central aspirating device of the spinning frame through a connecting conduit.

A comparable open-end spinning device, slightly modified in the area of the debris outlet opening, is described in German Patent Publication DE 28 56 028 C2. In this case, the debris outlet opening is also designed as an aspirating opening for an air flow directed into the opening cylinder housing to prevent spinnable fibers from being released from the opening cylinder along with debris particles. This air flow is directed onto the opening cylinder to act in the nature of a pneumatic guide to keep the opened fibers on the opening cylinder as a result of their relatively large specific surface in relation to their low mass. However, the debris particles, because of their size and mass, have a clearly higher kinetic energy which overcomes this air flow, causing the debris particles to be propelled away tangentially. Subsequently, the debris particles are entrained by a further air flow and are removed through an aspirating opening. A debris chamber is disposed directly adjoining the debris outlet opening of the opening cylinder housing, which is divided into a debris separating zone and a debris removal zone by means of an air guide wall disposed at a short distance from the debris outlet opening.

Another open-end rotor spinning device with a debris chamber disposed underneath the opening cylinder is known from German Patent Publication DE 43 10 810 A1, which has two separate air flow systems with their own respective aspirating openings. An air flow system acting in the bottom area of the debris chamber disposes of the debris particles combed out by the opening cylinder, while a second, oppositely acting air flow system terminates in a suction flow rotating along with the opening cylinder. The particular disposition of the aspirating opening results in an essentially definite separation of the two flow systems.

Furthermore, the later published German Patent Publication DE 43 34 483 describes an open-end spinning device which has an opening cylinder housing disposed in the pivoted cover element of the spinning unit to be pivotable along with the cover element. The opening cylinder housing has a debris outlet opening with an associated pneumatically chargeable debris reception element disposed at a spacing opposite the opening, resulting in a free space between the debris outlet opening and the debris reception element which communicates with the ambient air. The debris reception element is releasably fastened on the cover element seated on a pivot shaft and is tilted downward around the pivot shaft together with the cover element when the spinning device is opened.

Debris removal at the opening cylinder housings of a rotor spinning frame represents an important element in achieving the objective of faultless processing of fiber materials. Even though the technology of the debris removal devices appears to be relatively simple, these devices are nevertheless very difficult and react sensitively to changes. Even small modifications in the area of the debris outlet openings can disadvantageously change the flow conditions and thereby have a considerable effect on the spinning result which can be achieved.

SUMMARY OF THE INVENTION

Based on the known open-end spinning devices described above, it is an object of the present invention to provide an improved pneumatic debris removal arrangement and, in particular, not provide a debris removal arrangement which can be universally employed.

Briefly summarized, the present invention is adapted to essentially any open-end spinning frame comprising a plurality of aligned spinning stations and a common debris disposal conduit extending along the spinning stations, wherein each spinning station has a spinning rotor drivenly rotated within a rotor housing, a sliver opening device having an opening cylinder rotating in an opening cylinder housing formed with a debris outlet opening, and a pivotable cover having a fiber conduit plate movable with the cover into and out of covering relation to the rotor housing. According to the present invention, each spinning station is equipped with a support rail to which a debris disposal means is mounted in a disposition which is below the debris outlet opening in the open cylinder housing for receiving debris therefrom and which is out of the pivoting path of movement of the cover so as not to interfere with movement of the cover. Basically, the debris disposal means comprises a debris pickup funnel disposed at a spacing from the debris outlet opening of the opening cylinder housing and a connector conduit connecting the debris pickup funnel to the common debris disposal conduit.

The basic design of the pneumatic debris aspirating arrangement of the present invention has the advantage, among other things, that retrofitted installation of the device is possible in rotor spinning frames of the type originally designed for mechanical debris disposal without structural changes in the spinning stations being necessary. Thus, the present debris disposal arrangement makes it possible to equip a rotor spinning machine selectively with either a mechanical or a pneumatic debris disposal installation, and to change the selection later if desired. For example, an existing mechanical debris disposal system can be replaced without problems by the pneumatic debris aspirating device in accordance with the present invention.

In particular, the design of the debris aspirating device in accordance with the present invention, as well as the manner of its installation on the spinning units, assure that none of the functions of the spinning units, especially the opening of the covers for cleaning or other maintenance of the spinning stations, are interfered with in any way.

In a preferred embodiment, the pneumatic debris aspirating device, which is disposed underneath the pivot housings of the rotor spinning units, essentially consists of a debris pickup funnel connected directly or indirectly via a rear aspiration connector to a debris disposal conduit which is charged with a vacuum and extends over the length of the machine. The debris pickup funnel preferably has a transversely extending connecting strip with bores, by means of which the pickup cone can be fixed in place on the support rail disposed on the spinning units. If required, the guide conduit elements of a mechanical debris disposal installation are also fastened on these support rails.

In an advantageous embodiment, the debris pickup funnels may be embodied as asymmetrical injection- molded parts, preferably made of plastic. On the one hand, a component designed in this way can easily be adapted to the structural realities of existing open-end spinning frames, and on the other hand such injection-molded parts can be economically produced, which is also advantageous in view of the great number of spinning stations.

Preferably, the rear aspirating connector of the debris pickup funnel is extended rearward closely underneath the support rail of the rotor spinning units and is connected by a flexible line, for example a spiral hose, to the vacuum-charged debris conduit.

According to a further aspect of the invention, the debris disposal conduit may be embodied as a suction rail extending longitudinally along the full length of the machine, for example underneath a conduit utilized for electrical energy supply. Preferably, the debris disposal conduit is connected at the end of the machine to an aspiration system which is part of the spinning mill and which has, among other things, a filter arrangement and a vacuum source.

DETAILED DESCRIPTION OF THE PREFERRED EMBODIMENT

Figure 1:
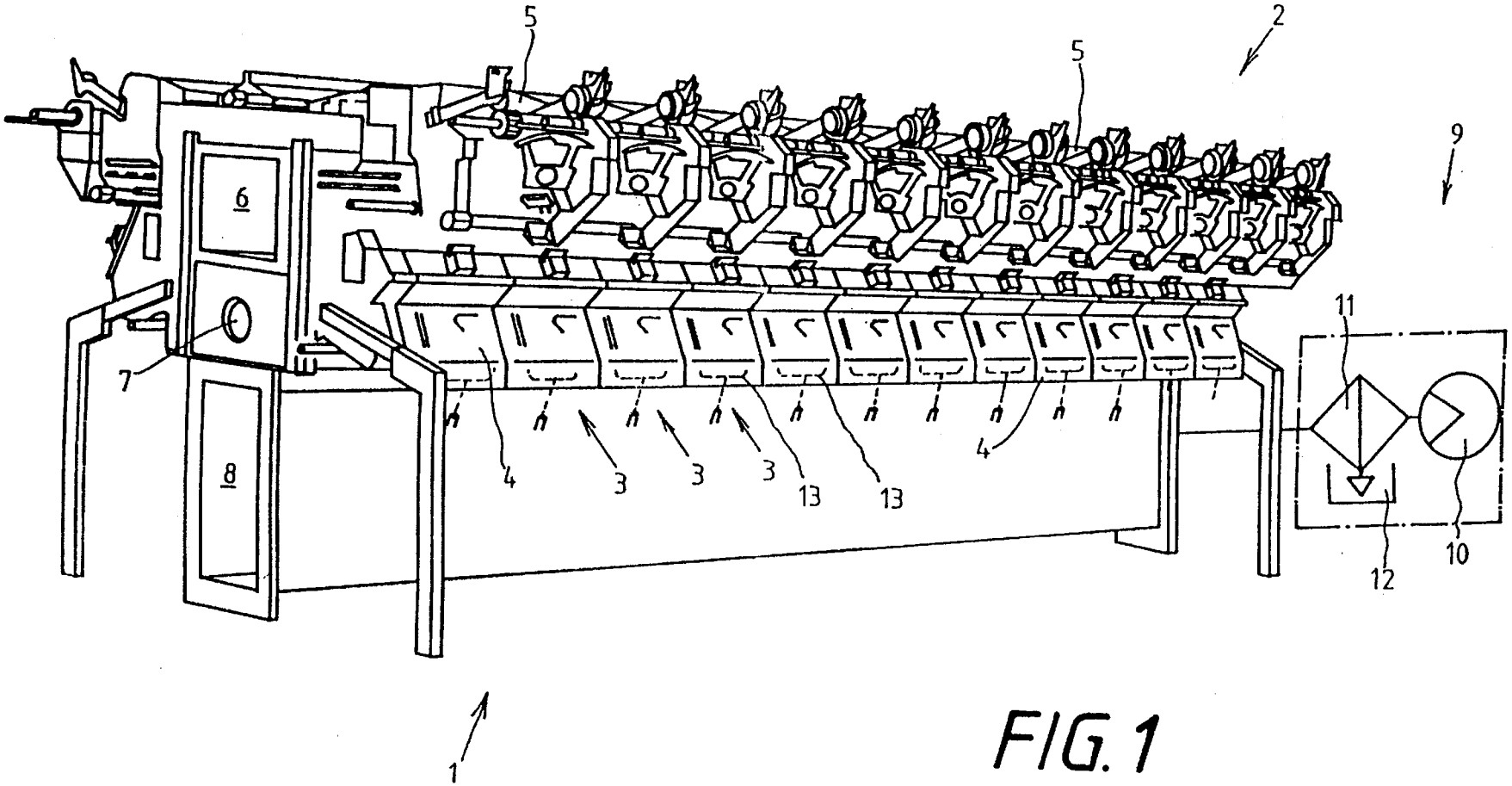
FIG. 1 is a perspective view of a frame unit of an open-end rotor spinning frame with an integrated debris collecting conduit, for assemblage with one or more additional frame units to form a completed open-end spinning frame, and including a schematic representation of an aspirating device forming part of the spinning mill to which the debris collecting conduit is connected.

FIG. 1 depicts an intermediate frame unit 2 of an open-end rotor spinning frame i which is typically assembled end-to-end with additional intermediate frame units 2 (up to twelve intermediate units in total), and a drive frame unit (not shown) at one end of the intermediate units 2 and an end frame unit (also not shown) at the opposite end of the intermediate units 2. As shown, each one of these intermediate units 2 has twenty-four spinning stations 3 (twelve on each side). Each respective spinning station 3 has one open-end rotor spinning unit 4 and a yarn winding unit 5.

As further represented in FIG. 1, each intermediate unit 2 has an aspirating conduit 6 by means of which a common vacuum source is applied to the rotor housings 20 (FIG. 2) of the rotor spinning units 4. An electrical supply conduit 7 and a debris collecting conduit 8 are disposed underneath the aspirating conduit 6. The debris collecting conduit 8 is embodied as a suction rail of the same length as the machine and is connected to an aspirating device 9, typically part of the spinning mill in which the spinning frame is disposed, which basically comprises, among other things, a suction source 10, a filter element 11 and a debris disposal unit 12. Each spinning station 3 also is equipped with a pneumatic debris aspiration device, indicated only schematically at 13 in FIG. 1, the pneumatic debris aspirating devices 13 of the rotor spinning units 4 being individually connected to the debris collection conduit 8 as indicated schematically by broken lines in FIG. 1.

Figure 2:
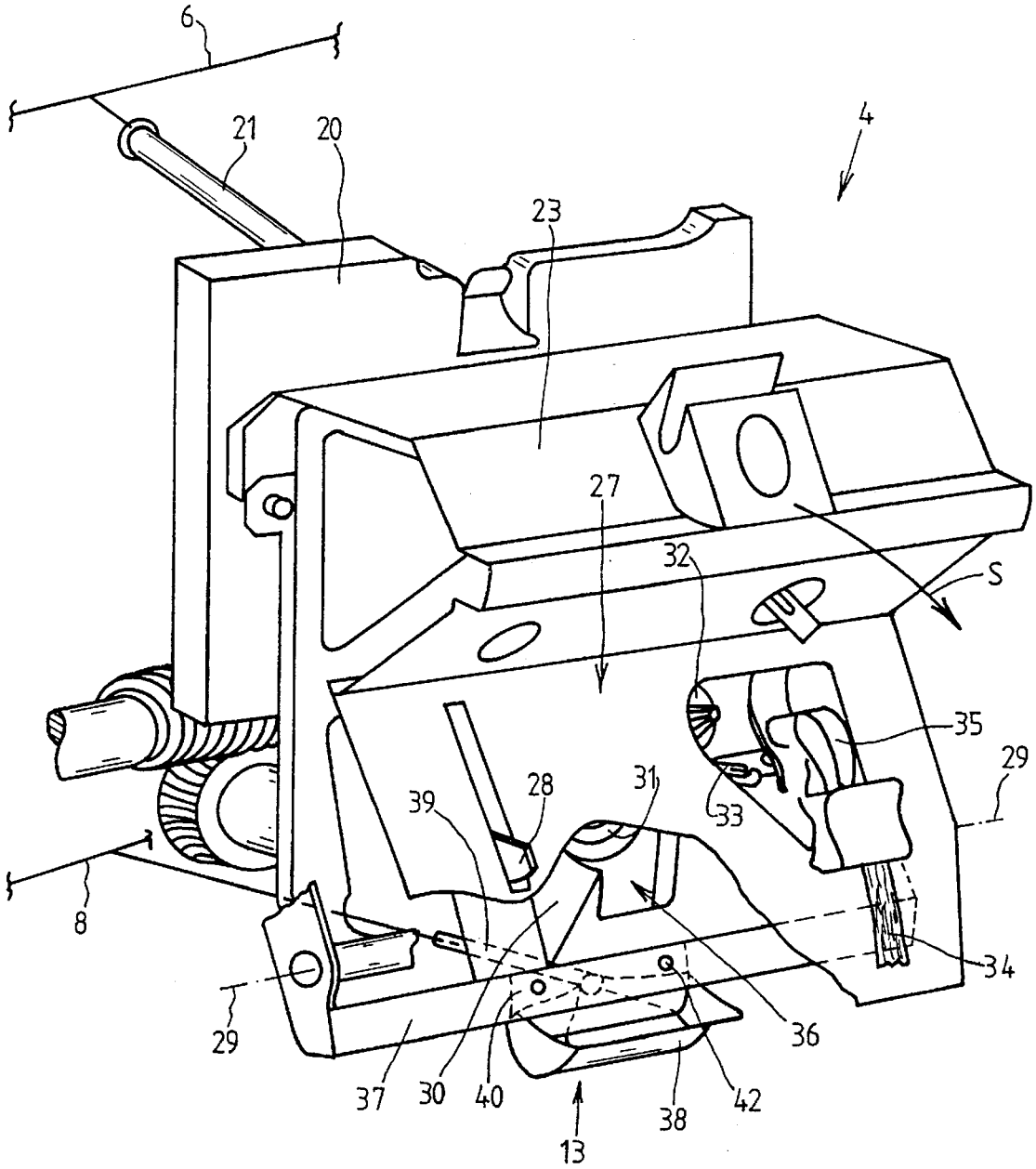
FIG. 2 is a perspective view of a rotor spinning unit with a debris pickup cone underneath the open cylinder housing, in accordance with the present invention.
Figure 3:
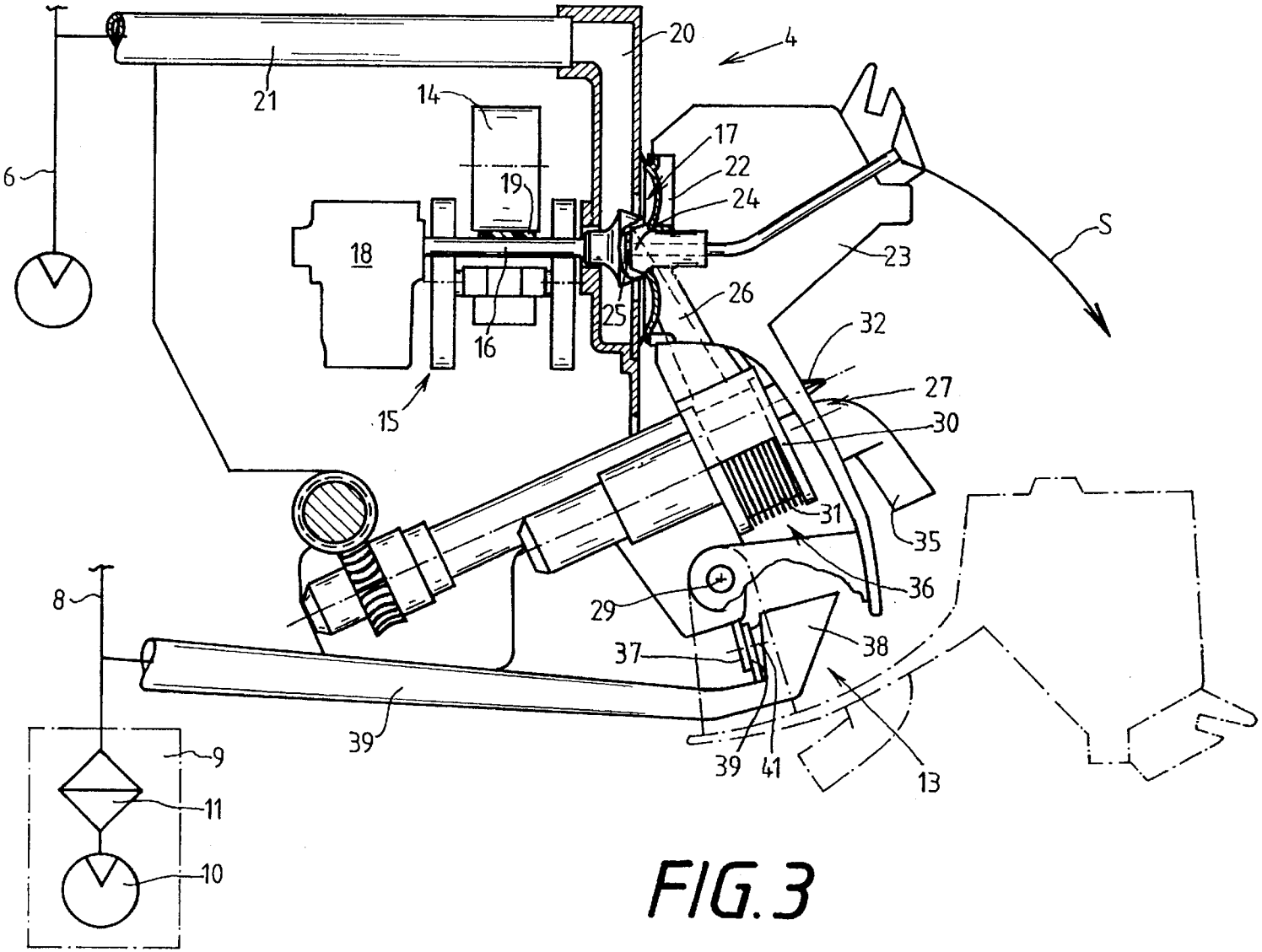
FIG. 3 is a vertical cross-sectional view of the rotor spinning unit of FIG. 2, illustrating the pneumatic debris aspirating device in accordance with the present invention.

The rotor spinning units 4 are represented in more detail in FIGS. 2 and 3. As is known, each spinning unit 4 includes a spinning rotor 17 mounted to one end of a rotor shaft 16 which is rotatably seated on a set of supporting disks 15, with the opposite end of the shaft 16 supported in an axial bearing 18 against axial forces acting on the rotor. The spinning rotor 17 is driven via a tangential belt 19 to rotate at a high speed in the rotor housing 20. The rotor housing 20 is connected via a connecting line 21 to the aspirating conduit 6.

The rotor housing 20 is closed at its forward side by a fiber conduit plate 22, which is fastened on a cover assembly 23 pivotably mounted to the spinning unit 4. A yarn draw-off nozzle 25 is disposed centrally in an extension 24 of the fiber conduit plate 22. In addition, the cover assembly 23 includes a sliver opening device 27 supported within the cover assembly 23 and a two-part fiber guide conduit 26 which extends from the sliver opening device 27 and terminates in the plate extension 24 to connect the opening device 27 with the interior of the spinning rotor 17. The cover 23 is affixed to a pivot shaft 29 and is normally secured in covering relation over the spinning rotor 17 and the rotor housing 20 by a latch 28, which upon release permits pivoting movement of the cover 23 in the direction S into a first cleaning position or a second maintenance position.

The sliver opening device 27 essentially consists of a sliver draw-in trough 33 opening outwardly through the cover 23 in facing relation to a sliver feed condenser 35, a driven sliver draw-in cylinder 32 disposed within the cover, and a driven opening cylinder 31 rotating inside a sliver opening housing 30 within the cover 23 adjacent the draw-in cylinder 32. The sliver 34 is fed into the sliver opening device 27 via the condenser 35. The housing 30 surrounding the opening cylinder 31 is partially open to define a downwardly oriented debris outlet opening 36.

Each rotor spinning unit 4 is equipped with a pneumatic debris aspirating device 13 fixed in place on a support rail 37 of the spinning unit 4 at a distance below the opening cylinder housing 30. Each debris aspirating device 13 has an asymmetrically formed debris pickup funnel 38 opening upwardly toward the debris outlet opening 36 of the associated opening cylinder housing 30 and is connected via a rear aspirating conduit 39 to the vacuum-charged debris conduit 8 of the rotor spinning frame 1.

Figure 4:
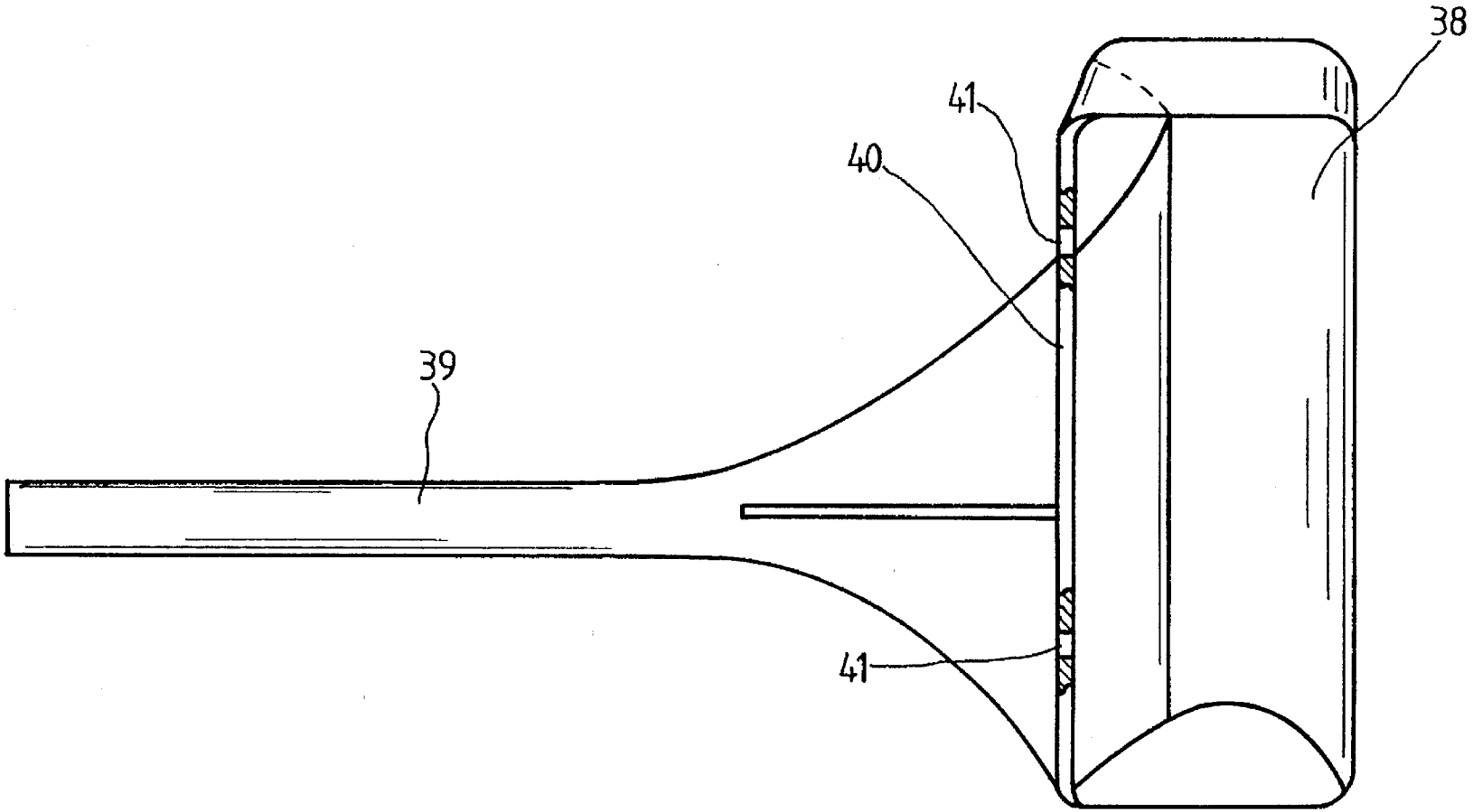
FIG. 4 is a top view of a debris pickup cone of FIG. 2.

As can be seen from FIG. 4 in particular, the debris pickup funnel 38 comprises an asymmetrical receptacle portion defining an upwardly opening debris receiving opening, and the receptacle is asymmetrically tapered inwardly and rearwardly into a rear connecting portion. The receptacle portion of the debris pickup funnel also has a connecting strip 40 formed with fastening bores 41 by which the debris pickup funnel 38 can be fastened on the support rail 37 of the associated rotor spinning units 4.

In the installed state of the pneumatic debris aspirating device, a freely accessible space is created between the downward debris outlet opening 36 of the opening cylinder housing 30 and the upward opening of the debris pickup funnel 38, which permits air to be aspirated without interruption into opening cylinder housing 30 and, in particular, without being negatively affected in any way by the suction force being applied into the aspirating connector 39.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning frame comprising a plurality of aligned spinning stations and a common debris disposal conduit extending along the spinning stations, each spinning station having:

a spinning rotor drivenly rotated within a rotor housing, a sliver opening device having an opening cylinder rotating in an opening cylinder housing formed with a debris outlet opening, a pivotable cover having a fiber conduit plate movable with the cover in a path between a closed position in covering relation to the rotor housing and an open position out of covering relation to the rotor housing, a support rail, and a debris disposal means mounted to the support rail in a fixed disposition out of the path of movement of the pivotable cover so as not to interfere with movement of the pivotable cover between the open and closed position, the debris disposal means having a debris pickup funnel disposed at a spacing from the debris outlet opening of the opening cylinder housing for receiving debris therefrom and having a connector conduit connecting the debris pickup funnel to the common debris disposal conduit, the opening cylinder housing and the pickup funnel defining a freely accessible space therebetween.

2. An open-end spinning frame in accordance with claim 1, wherein the support rail has bores for receiving fasteners for affixing the debris disposal means thereto.

3. An open-end spinning frame in accordance with claim 1, wherein the debris pickup funnel has an asymmetrical debris receptacle portion and a rail-fastening element disposed on the funnel, and the connector conduit is eccentrically connected to the receptacle portion.

4. An open-end spinning frame in accordance with claim 3, wherein the debris pickup funnel is an injection-molded element.

5. An open-end spinning frame in accordance with claim 4, wherein the debris pickup funnel is made of plastic.

6. An open-end spinning frame in accordance with claim 1, wherein the connector conduit extends below the support rail and is connected via a flexible line with the common debris disposal conduit.

7. An open-end spinning frame in accordance with claim 6, wherein the flexible line comprises a spiral hose.

8. An open-end spinning frame in accordance with claim 6, wherein the common debris disposal conduit comprises a suction rail of the same length as the plurality of spinning stations and adapted to be connected at the end of the spinning frame with a source of suction.

9. An open-end spinning frame comprising:

a plurality of aligned spinning stations, each spinning station having an opening cylinder and an opening cylinder housing formed with a debris outlet opening, and having a cover pivotally mounted thereto movable in a pivotable path between a closed position in covering relation to the spinning station and an open position out of covering relation to the spinning station, a common debris disposal conduit extending along the spinning frame beneath all of the spinning stations, a support rail disposed in fixed relation below each spinning station, and a pneumatic debris aspirating arrangement fixedly mounted to the support rail of each spinning station out of the path of movement of the cover of each spinning station, each pneumatic debris aspirating arrangement including a debris pickup funnel disposed at a spacing below the debris outlet opening of the opening cylinder housing for receiving debris therefrom and a connector conduit disposed below each spinning station connecting the debris pickup funnel to the common debris disposal conduit for removal of the debris from the spinning frame.

* * * * *